US006385884B1

(12) United States Patent
Valiulis

(10) Patent No.: US 6,385,884 B1
(45) **Date of Patent: *May 14, 2002**

(54) MERCHANDISE HANGERS PROVIDING READY REPLACEABILITY OF ADHESIVE DISPLAY LABELS

(75) Inventor: Thomas E. Valiulis, Rockford, IL (US)

(73) Assignee: Southern Imperial, Inc., Rockford, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/752,529

(22) Filed: Nov. 20, 1996

(51) Int. Cl.[7] ..... G09F 3/00

(52) U.S. Cl. ..... 40/642.01; 40/638; 40/661.03; 40/661.09; 283/81

(58) Field of Search ..... 40/638, 642.01, 40/661.03, 661.09, 595, 594; 283/81

(56) References Cited

U.S. PATENT DOCUMENTS

| | | | | | |
|---|---|---|---|---|---|
| 2,563,340 | A | * | 8/1951 | Kelly | 283/81 |
| 3,912,084 | A | | 10/1975 | Valiulis | |
| 4,250,642 | A | * | 2/1981 | Riehle | 40/594 X |
| 4,452,360 | A | | 6/1984 | Barnes | |
| 4,589,685 | A | * | 5/1986 | Lazar | 283/81 |
| 4,718,626 | A | * | 1/1988 | Thalenfeld et al. | 40/642.01 X |
| 4,783,033 | A | | 11/1988 | Valiulis | |
| 4,787,159 | A | * | 11/1988 | Fast | 40/642.01 |
| 4,805,861 | A | * | 2/1989 | Thalenfeld et al. | 40/642.01 X |
| 4,850,557 | A | | 7/1989 | Valiulis | |
| 4,882,868 | A | * | 11/1989 | Fast | 40/642.01 |
| 4,900,604 | A | * | 2/1990 | Martinez et al. | 40/594 X |
| 4,976,058 | A | | 12/1990 | Valiulis | 40/657 |
| 5,120,941 | A | * | 6/1992 | Reilley et al. | 283/81 X |
| 5,231,779 | A | | 8/1993 | Valiulis et al. | 40/649 |
| 5,236,163 | A | | 8/1993 | Valiulis | |
| 5,269,691 | A | * | 12/1993 | Waldmann | 40/594 X |
| 5,299,834 | A | * | 4/1994 | Kraige | 283/81 X |
| 5,325,616 | A | | 7/1994 | Valiulis | 40/299 |
| 5,343,647 | A | * | 9/1994 | Bulka | 40/638 X |
| 5,428,914 | A | * | 7/1995 | Whitehouse et al. | 40/594 X |
| 5,464,681 | A | * | 11/1995 | Luce | 40/594 X |
| 5,597,634 | A | * | 1/1997 | Bloomer et al. | 428/40.1 |
| 5,628,858 | A | * | 5/1997 | Petrou | 40/594 X |
| 5,639,125 | A | * | 6/1997 | Garrison | 283/81 |
| 5,704,650 | A | * | 1/1998 | Laurash et al. | 283/81 |
| 6,145,231 | A | * | 11/2000 | Valiulis | 40/661.03 |

FOREIGN PATENT DOCUMENTS

| | | | | |
|---|---|---|---|---|
| DE | 3307694 | * | 9/1984 | 40/594 |

* cited by examiner

*Primary Examiner*—B. Dayoan
*Assistant Examiner*—Andrea Chop
(74) *Attorney, Agent, or Firm*—Leydig, Voit & Mayer, Ltd.

(57) ABSTRACT

A display hanger for attachment to a "Pegboard" type of support panel is provided with an outer display panel that has a release coating, such as of silicone, for ready attachment, removal and replacement of labels that carry indicia pertinent to the marketing of products on the hangers to passing potential customers.

31 Claims, 2 Drawing Sheets

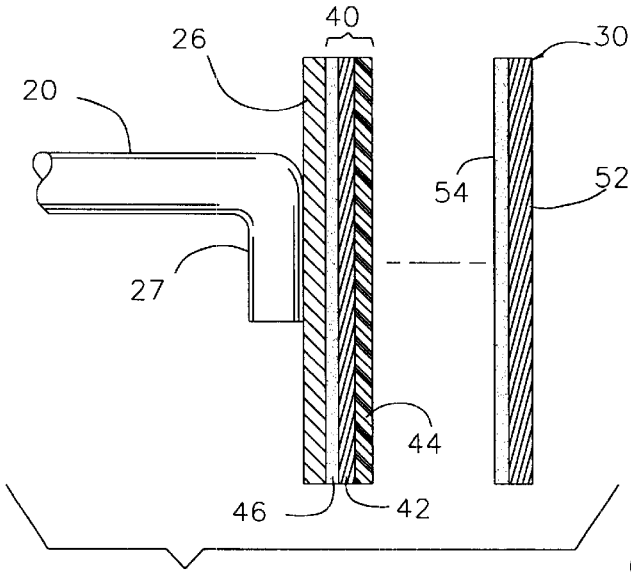
Fig. 3
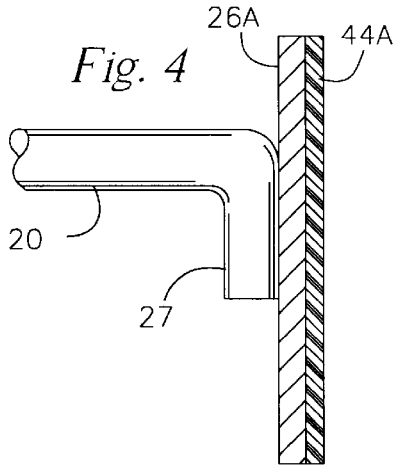
Fig. 4
Fig. 6
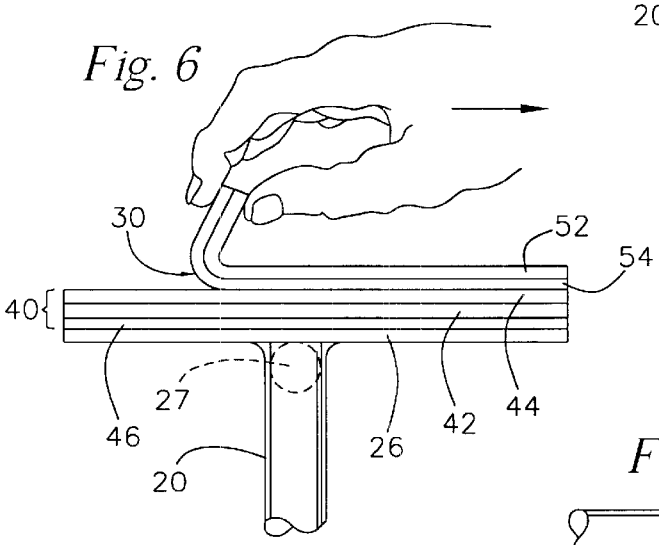
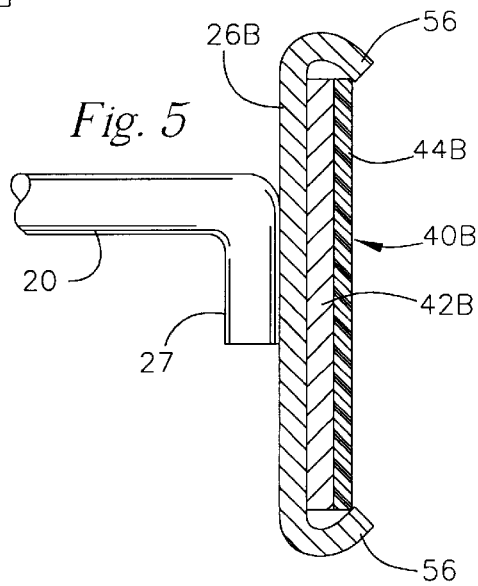
Fig. 5

MERCHANDISE HANGERS PROVIDING READY REPLACEABILITY OF ADHESIVE DISPLAY LABELS

RELATED APPLICATION

The disclosure of the application entitled Marketing Displays Providing Ready Replaceability of Adhesive Display Labels filed concurrently herewith is incorporated herein by reference.

FIELD OF THE INVENTION

This invention relates to merchandise hangers such as so-called "Pegboard" hooks.

BACKGROUND OF THE INVENTION

As is well known, many hangers which are used to support and display merchandise include an arm that is adapted to be supported at one end and to project in cantilever fashion for convenient access to allow addition and removal of merchandise items. A common type is the so-called "scanning pegboard hook" which has two arms and is adapted to be attached to a perforated panel to effect such support and display of merchandise. A so-called scanner arm usually is spaced above a hanger arm. The hanger arm supports the merchandise. A label support is provided on the outer end of the scanner arm for supporting and prominently displaying a label or "tag" that may contain pricing, stockkeeping units and other information and indicia pertaining to the merchandise on the hanger arm. These arms often are elongated pieces of wire or rod which extend horizontally from the rear support end of the hanger. Examples of such hangers and attached display supports are shown in U.S. Pat. Nos. 3,912,084, 4,452,360, 4,783,033, 4,850,557, 4,976,058, 5,231,779, 5,236,163 and 5,325,616 which are incorporated herein by reference. Such hangers may be formed of different diameter wire or rods, e.g., relatively small diameter wires for light duty and heavier arms made of larger diameter wire for heavy duty, or arms of other cross-sectional configurations.

In such merchandise displays, it is desirable to permit ready application, removal and exchange of information labels, e.g. as in instances of changing of the products, prices, sale announcements, images which facilitate inventorying, and other pertinent information.

OBJECTS AND SUMMARY OF THE INVENTION

The general aim of the present invention is to provide merchandise hangers such as "Pegboard" hooks having an improved label holder arrangement that permits easy removal and replacement of adhesive labels on such hangers.

A more specific object of the invention is to provide such hangers and related labels which assure smooth attractive affixation of each adhesive label while also providing simple, quick and economical removal and replacement as well as exchange of the labels as marketing circumstances and product information change.

These and other objects and advantages of the invention will become more apparent from the following description and the accompanying drawings.

A hanger assembly is provided for hanging and displaying merchandise at the front face of a perforated panel such as a so-called "pegboard" that is disposed in a generally vertical plane. The hanger has at least one elongated arm. An engagement section at the rear end of the hanger includes a plurality of appropriately spaced fingers or hooks which extend rearwardly as "horns" for engaging in the holes of such a perforated panel to support the hanger assembly on the panel in a generally horizontal position. The arm or arms thus extend generally horizontally from the panel and typically are generally perpendicular to the plane of the panel. A label support which typically is in the form of a small flat panel or holder is mounted on the front end of one arm of the hanger and presents a surface exposed outwardly relative to the arm.

A release layer, such as a thin coating of a silicone material, is provided on the outer surface of the label panel. This release layer adherently retains and supports an adhesively coated label that is pressed onto that surface and will readily release such a label, i.e. will permit the label to be peeled off cleanly with little effort, normally without tearing or splitting the label or leaving any residue therefrom on the label panel surface. Thereby labels applied to the label panel are exposed outwardly relative to the arm for viewing by customers who pass by the display. The labels also are readily removable and replaceable, as well as exchangeable, by merchandising personnel as the facts and circumstances to be displayed change from time to time.

In the preferred embodiments, the release layer is affixed to the label support. One such embodiment utilizes a thin flexible liner or carrier member. This member includes a carrier body layer such as of paper or a synthetic base stock and is adhered to the support surface of the label support panel in a relatively permanent manner. The release layer is provided on the opposite side of the carrier body and thereby is exposed outwardly. In another preferred embodiment, the release layer is applied as a coating directly onto the label support panel. In each instance, adhesively backed labels are readily attached smoothly on the release layer and are readily and easily removable and replaceable manually by store personnel.

In another embodiment the label support at the outer end of the hanger may be provided with flanges, tabs or other lips or the like which serve as engagement elements to engage and retain a thin label carrier member. That carrier member includes a carrier body of a size, configuration and stiffness to engage within the engagement elements for retention thereby. A release layer is provided on the surface of the label carrier member which is disposed outwardly to releasably support adhesive labels thereon in the same manner as noted above.

BRIEF DESCRIPTION OF THE DRAWINGS

FIG. 3 is an enlarged somewhat schematic partial vertical sectional view taken generally at line 3—3 of FIG. 1 with the label in a detached position.

FIG. 4 is a sectional view similar to FIG. 3 and showing another embodiment employing teachings of this invention.

FIG. 5 is a sectional view similar to FIG. 3 and showing another embodiment employing teachings of this invention.

FIG. 6 is a top view which schematically illustrates the "peeling" removal of a label from the hanger assembly of FIG. 1.

Figure 1:
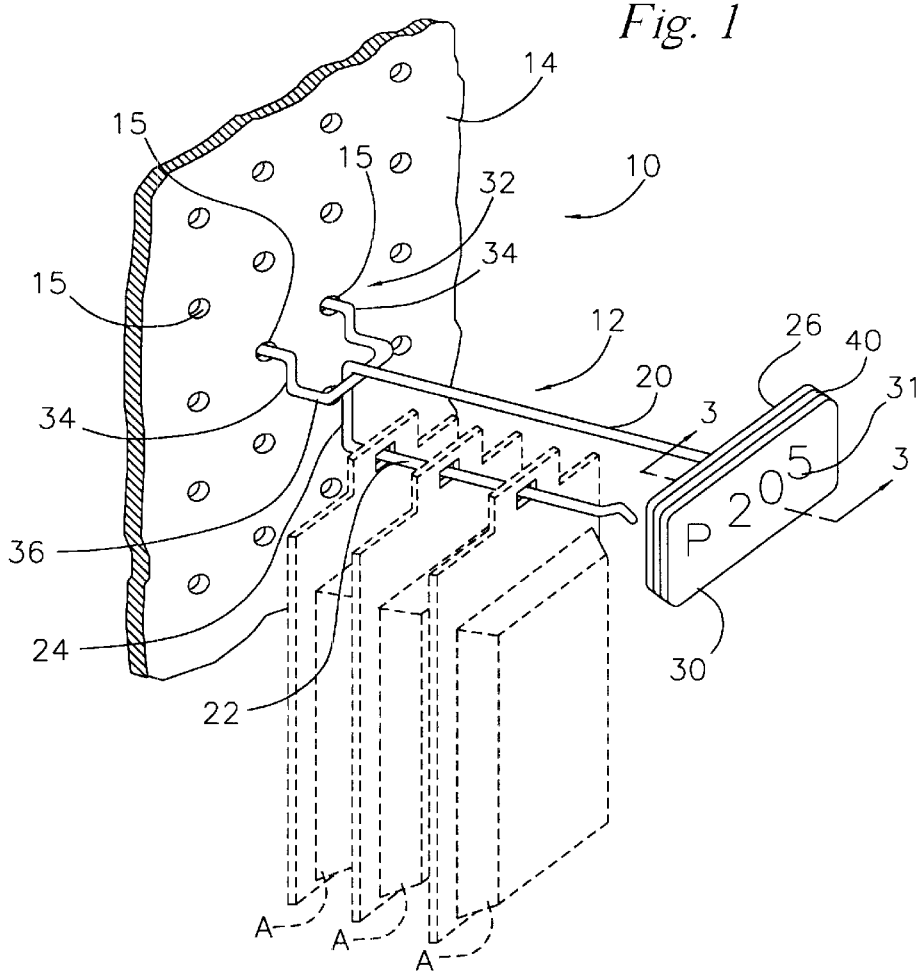
FIG. 1 is a perspective view of a typical display hanger assembly which employs teachings of the present invention, and illustrating a panel on which the hanger is mounted as well as merchandise supported on the hanger.

The thickness of various layers of materials and coatings are exaggerated in the various drawing figures for convenience and clarity of illustration.

While the invention is susceptible to various modifications and alternative constructions, preferred embodiments have been shown in the drawings and will be described in detail. It will be understood, however, that there is no intention to limit the invention to the specific embodiments illustrated or described herein, but on the contrary the intention is to cover all modifications, alternative constructions and methods and equivalents falling within the spirit and scope of the invention.

DETAILED DESCRIPTION OF THE PREFERRED EMBODIMENT

For purposes of illustration, one presently preferred embodiment of the invention is shown in the drawings in connection with a hanger assembly 10. That assembly includes a product support hanger 12 for supporting one or more articles A from a panel or "Pegboard" 14 of the type formed with a series of vertically spaced and horizontally extending rows of holes 15. In this instance, the articles A have been illustrated as being bubble packages within which merchandise is contained. The upper end portion of each bag is formed with a hole to enable the bag to be hung from the hanger 12.

Herein, the product support hanger 12 is generally U-shaped and is made of a round rod or wire. The hanger includes upper and lower outwardly projecting generally horizontal arms 20 and 22 whose inner ends are formed integrally with and are joined by an upright connecting bight piece or connector portion 24. The lower arm 22 supports the articles A and often is referred to as the hanger arm. The upper arm 20 is often referred to as a scanner arm and carries a label support member 26 at its outer end. The illustrated support member 26 is a flat metal plate which is spot-welded to a vertical L-finger 27 on the inner end of the scanner arm 22; see FIGS. 3–5. However, the label support may have any of a variety of configurations and modes of attachment to the scanner arm; see for example the hangers described and illustrated in the United States patents referred to above.

The label support member 26 presents an outwardly exposed generally planar surface 28 for supporting labels or other displays of readable information to passing customers and/or to merchandising personnel concerning the merchandise to be sold from the hanger 12. To this end, the member 26, and specifically its outwardly exposed surface 28, extends generally orthogonally relative to the longitudinal axis of the arm 20. Labels 30 or other display pieces are supported on the surface 28. The labels are printed with indicia 31 such as the identification of the products in containers A, the price, stock number, inventory indicia or other information to be read by potential customers and/or by merchandising personnel.

The hanger assembly 10 further comprises a suitable mounting or engagement section 32 at its rear end for removably mounting the hanger 12 on the panel 14. The section 32 includes generally L-shaped fingers or horns 34 for extending through the holes 15 through a panel 14 in a hook-like fashion whereby engagement of the fingers 34 in the holes 15 and with the rear surface of the panel, along with the concurrent abutment of the lower portion of bight 24 with the front face of the panel, supports the hanger 12 in its generally horizontal position. In the illustrated bracket, the fingers 34 are opposite ends of a U-shaped mounting rod element 36 that is affixed at the upper inner portion of the bight 24, as by spot welding. However, it will be appreciated that the mounting arrangement for supporting the bracket 12 on a pegboard or similar support fixture may be of a wide variety of configurations.

FIGS. 3–5 illustrate three embodiments for releasably and removably supporting display labels on the inner surface of the label support plate 26, 26B. Each embodiment presents a label support surface formed by a release coating 44, 44A, 44B to facilitate the removal and replacement of synthetic or paper adhesive labels. In each instance, when an adhesive label is applied to the release layer, the label will not slide or fall off. However, when it is desired to remove the label, it peels off with little effort, normally without tearing or delaminating the label and leaving no residue from the label on the support surface.

Figure 2:
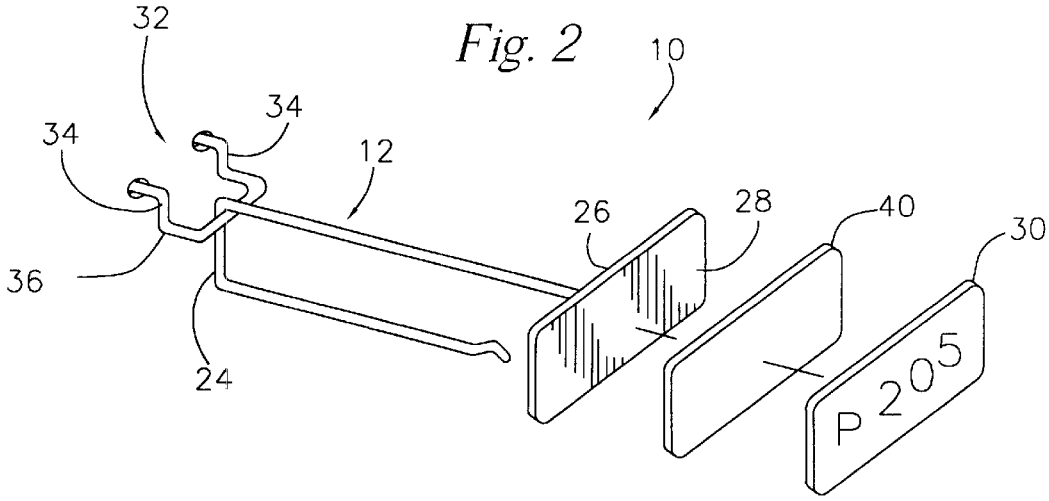
FIG. 2 is a perspective view of the hanger assembly of FIG. 1, with the label support liner and a label for placement thereon shown in exploded positions.

More particularly, in FIGS. 1–3, a label release liner or carrier 40 includes a carrier body 42 with a release coating 44 on its outer side. A layer of adhesive 46 attaches the carrier member 40 relatively permanently to the outer surface of the label support plate 26. In the illustrated preferred embodiment, the carrier member 42 is a thin flexible sheet of paper or synthetic material which carries the adhesive layer or coating 46 on one side and the release coating or layer 44 on the opposite side. The release layer 44 preferably is a thin coating of a silicone resin or similar material which will retain a flexible adhesively backed paper label smoothly and uniformly on the label support plate without sliding or falling off. Thereby, indicia 31 will be correctly and pleasingly presented to customers who are passing and have access to the merchandise on the hangers.

As indicated in FIG. 3, the label 30 typically includes a paper or synthetic stock body 52 carrying an appropriate adhesive 54 on one side and indicia printed r otherwise displayed on the opposite side; see indicia 31 indicated in FIGS. 1 and 2. The release layer 44 permits a previously mounted label 30 to be removed by peeling it off cleanly, with little effort and without leaving residue of the label adhesive 54 or portions of the label body 52 on the surface of the layer 44. Such a removal typically comprises raising a corner or edge, as with a fingernail, and pulling outward on the label, i.e. peeling it off by pulling on the freed edge in a direction generally away from the surface and progressively back over the attached portion of that label surface 28 as illustrated generally in FIG. 6. A liner 40 with a release coating 44 may be applied to the label support plate 26 at any time, e.g., by a manufacturer, or by a distributor or by a customer prior to mounting the hangers on a pegboard, or may be applied to hangers already mounted on pegboards.

In the embodiment illustrated in FIG. 4, a release layer 44A is applied as a coating directly on the outer surface of the label support plate 26A. An adhesive label 30 is mountable on and removable from the front exposed surface layer 44A in the same manner noted in respect to the embodiment of FIG. 3.

In the embodiment of FIG. 5, a carrier member 40B is provided which comprises a carrier body element 42B, such as of paper or synthetic material, with a release coating 44B on one side. The carrier member 40B serves somewhat similarly to the liner 40 of FIG. 3, except there is no adhesive layer on the inner side. The carrier member 40B is of an appropriate size and stiffness to be mounted by sliding or snap-in engagement between a pair of opposed lips 56 that are formed along the upper and lower edges of the label support plate 26B. Thus the carrier member 50B is supported mechanically, as opposed to being adhered to the support plate as in FIG. 3. The outwardly exposed release layer 44B removably supports label 30 in the same manner as described above.

The subject display support 26 may be formed of any suitable metal, synthetic plastic or similar material. The carrier body panel elements 42, 42B may be formed of paper stock or a synthetic material such as polyester, polyvinylchloride (PVC), polypropylene or polyurethane of suitable weight and stiffness or flexibility. One example is a 50# minimum bleached super calendar kraft (SCK) paper.

The adhesive 46 may be any adherent material that is compatible with the materials of the support 26 and the carrier panel body 42 and which provides adherent strength (bond tensile strength) between the support surface 28 and the panel body 42 that is substantially greater than the adherent strength of the bond between the release layer 44 and the adhesive 54. Examples of typical suitable adhesives 46 include rubber-based and acrylic adhesives, which may be pressure sensitive adhesives and may be the same as or different from the adhesive 54 of the labels 30. The release layer assures ready parting at the interface between the layer 44 and the adhesive 54 even if the adhesive 54 has the same or a higher bonding strength potential than the adhesive 46.

In each embodiment, the release layer or coating 44, 44A, 44B preferably is a silicone material, i.e., contains a silicone and appropriate amounts of controlled release additives (CRA resins), which releasably supports labels 30 that use typical pressure sensitive adhesive layers 54. However, the release layer 44 may be formed of any material which will similarly retain an adhesively applied label in place while also assuring a sufficiently low adherent strength of the bond between the adhesive 54 and the layer 44, 44A, 44B to permit the label to be easily and completely removed by peeling it from the support panel, normally as an integral element. It will be appreciated that this is a function of the tensile strength and tear resistance of the label as well as the adherence/release bonds between the label adhesive 54 and both the label body 52 and the release layer 44, 44A, 44B. To these ends a silicone material which includes a moderate amount of CRA and that provides a release value less than two pounds, preferably less than about one pound, and particularly about 20–160 grams, for labels 30 adhered thereto by rubber-based or acrylic pressure sensitive adhesives such as are commonly used on present-day pressure sensitive labels, has been found satisfactory for the practice of this invention. Such a silicone material provides secure retention of the labels while assuring convenient integral removal of the labels by the attendant personnel when desired. Further, these results are attained when using ordinary paper labels, which are much less expensive than labels of synthetic materials, and even when using so-called "freezer grade" acrylic pressure sensitive adhesive for the adhesive layer 54. The latter adhesive is preferred for its higher and reliable adherent capabilities under adverse conditions.

One source of such a silicone material is Brown-Bridge Industries of Troy, Ohio. As used herein the term "release value" refers to the pulling force required to peel a 2" wide label from the release coating by pulling at 180° (parallel to the plane of the label, as illustrated generally in FIG. 6) at 300"/min. by the standard Tag and Label Manufacturers Institute (TLMI) test method.

As indicated above, the label adhesive 54 typically is a pressure sensitive adhesive such as is commonly used on mailing labels and the like, e.g. rubber based or acrylic pressure sensitive adhesives. The adherent or tensile strength of the releasable bond between the release layer 44, 44A, 44B and the adhesive 54 is substantially less than the bond of the adhesive 54 to the label body 52, and also substantially less than the bonds of the adhesive 46 to the carrier body 42 and to the support plate 26. Further, this releasable bond is substantially less than the tensile strength and tear strength of the label body 52, even when the label body 52 is a common paper label, and less than the delamination strength of the carrier body 42.

The aforedescribed release coating material may be applied to the respective designated surface areas by spraying, brushing or other coating techniques.

From the foregoing it can be seen that display supports have been provided which accomplish the aforenoted objects of this invention.

It will be understood that other variations, modifications and substitutions of equivalent configurations can be effected within the spirit and scope of this invention, particularly in light of the foregoing teachings. It is contemplated by the following claims to cover any such modifications and other embodiments that incorporate those features which constitute the essential features of the invention within the true spirit and scope of the following claims.

What is claimed is:

1. A hanger assembly for displaying merchandise from the front face of a perforated panel disposed in a generally vertical plane and having vertically spaced rows of horizontally spaced holes, said hanger assembly comprising a hanger for mounting in a generally horizontal position on such a panel, said hanger having an elongated arm with front and rear ends, an engagement section at said rear end of said arm, said engagement section including a plurality of horns extending rearwardly relative to said arm for engaging in such holes of such a perforated panel for supporting said hanger assembly on said panel with said arm extending generally horizontally from such a panel, a label support mounted at said front end of said arm, said label support having a surface exposed outwardly relative to said arm, and a release layer adhered to said surface and which will adherently receive and retain an adhesively coated label in overlying relation to said surface and readily release such a label, said release layer having a release value for adhesively coated labels which is substantially less than the release value of said surface of said label support for such labels, whereby such labels applied to said release layer are exposed outwardly relative to said arm and are -readily appliable, removable and replaceable by merchandising personnel.

2. A hanger assembly as in claim 1 in combination with a supply of multiple separate labels which have a pressure sensitive mounting adhesive thereon, wherein said release layer provides a bond strength to said pressure sensitive label adhesive which is less than the strength of adherent attachment of said release layer to said label support.

3. A hanger assembly as in claim 1 wherein said release layer is a coating that is bonded directly to said label support.

4. A hanger assembly as in claim 1 in combination with a supply of multiple labels having pressure sensitive adhesive on one side, for attachment of such labels to said release layer and subsequent removal therefrom.

5. A hanger assembly as in claim 1 in combination with a supply of multiple separate pressure sensitive adhesive labels, wherein said release layer provides a release value of less than about two pounds for said pressure sensitive adhesive labels when adhered thereto.

6. A hanger assembly as in claim 1 in combination with a supply of multiple separate pressure sensitive adhesive labels, wherein said release layer provides a release value of less than about one pound for said pressure sensitive adhesive labels when adhered thereto.

7. A hanger assembly as in claim 1 in combination with a supply of multiple separate pressure sensitive adhesive labels, wherein said release layer provides a release value of between about 20 grams and about 160 grams for said pressure sensitive adhesive labels when adhered thereto.

8. A hanger assembly for displaying merchandise from the front face of a perforated panel disposed in a generally vertical plane and having vertically spaced rows of horizontally spaced holes, said assembly comprising a hanger for mounting in a generally horizontal position on such a panel, said hanger having an elongated arm with front and rear ends, an engagement section at said rear end of said arm, said engagement section including a plurality of horns extending rearwardly relative to said arm for engaging in such holes of such a perforated panel for supporting said hanger assembly on said panel with said arm extending generally horizontally from such a panel, a label support mounted on said front end of said arm, said label support having a surface exposed outwardly relative to said arm, and a release layer adhered to said surface and which will adherently receive and retain an adhesively coated label in overlying relation to said surface and readily release such a label, said release layer having a release value for adhesively coated labels which is substantially less than the release value of said surface of said label support for such labels, whereby such labels applied to, said release layer are exposed outwardly relative to said arm and are readily appliable, removable and replaceable by merchandising personnel, wherein said release layer is a silicone material.

9. A hanger assembly for displaying merchandise from the front face of a perforated panel disposed in a generally vertical plane and having vertically spaced rows of horizontally spaced holes, said assembly comprising a hanger for mounting in a generally horizontal position on such a panel, said hanger having an elongated arm with front and rear ends, an engagement section at said rear end of said arm, said engagement section including a plurality of horns extending rearwardly relative to said arm for engaging in such holes of such a perforated panel for supporting said hanger assembly on said panel with said arm extending generally horizontally from such a panel, a label support mounted on said front end of said arm, said label support having a surface exposed outwardly relative to said arm, a release layer adhered to said surface and which will adherently receive and retain an adhesively coated label in overlying relation to said surface and readily release such a label, said release layer having a release value for adhesively coated labels which is substantially less than the release value of said surface of said label support for such labels, whereby such labels applied to said release layer are exposed outwardly relative to said arm and are readily appliable removable and replaceable by merchandising personnel, and including a label carrier member, said label carrier member including a carrier layer, an adhesive layer on one side of said carrier layer for adhesively affixing said carrier layer to said surface of said label support with the opposite side of said carrier layer disposed outwardly relative to said arm, and said release layer being on said opposite side of said carrier layer.

10. A hanger assembly as in claim 9 wherein said adhesive layer is adhesively bonded to said label support and thereby affixes said carrier layer to said label support.

11. A hanger assembly as in claim 9 wherein said carrier layer is a thin, generally flat sheet element.

12. A hanger assembly as in claim 9 wherein said carrier layer is a flexible paper sheet element.

13. A hanger assembly for displaying merchandise from the front face of a perforated panel disposed in a generally vertical plane and having vertically spaced rows of horizontally spaced holes, said hanger assembly comprising a hanger for mounting in a generally horizontal position on such a panel, said hanger having an elongated arm with front and rear ends, an engagement section at said rear end of said arm, said engagement section including a plurality of horns extending rearwardly relative to said arm for engaging in such holes of such a perforated panel for supporting said hanger assembly on said panel with said arm extending generally horizontally from such a panel, a label support mounted at said front end of said arm, said label support having a surface exposed outwardly relative to said arm, multiple separate adhesively coated labels for attachment to said surface, and a release layer adhered to said surface and which will adherently receive and retain at least one of said adhesively coated labels in overlying relation to said surface, said release layer having a release value for said adhesively coated labels which is substantially less than the release value of said surface of said label support for such labels and providing an adherent bond with the adhesive on said labels which is substantially less than the strength of adherence of said release layer to said label support, whereby each of said labels applied to said release layer is exposed outwardly relative to said arm and is readily appliable, removable and replaceable by another of said labels by merchandising personnel.

14. A hanger assembly as in claim 13 wherein said release layer is a coating of a silicone material.

15. A hanger assembly as in claim 13 wherein said labels are coated with a pressure sensitive adhesive.

16. A hanger assembly as in claim 15 wherein the strength of the adherent bond of said adhesively coated labels to said release layer is substantially less than the tensile strength and the tear strength of said labels.

17. A hanger assembly as in claim 16 wherein said release layer is a silicone material.

18. A hanger assembly for displaying merchandise from the front face of a perforated panel disposed in a generally vertical plane and having vertically spaced rows of horizontally spaced holes, said assembly comprising a hanger for mounting in a generally horizontal position on such a panel, said hanger having an elongated arm with front and rear ends, an engagement section at said rear end of said arm, said engagement section including a plurality of horns extending rearwardly relative to said arm for engaging in such holes of such a perforated panel for supporting said hanger assembly on said panel with said arm extending generally horizontally from such a panel, a label support mounted on said front end of said arm, said label support having a surface exposed outwardly relative to said arm, multiple separate adhesively coated labels for attachment to said surface, and a release layer adhered to said surface and which will adherently receive and retain at least one of said adhesively coated labels in overlying relation to said surface, said release layer having a release value for said adhesively coated labels which is substantially less than the release value of said surface of said label support for such labels and providing an adherent bond with the adhesive on said labels which is substantially less than the strength of adherence of said release layer to said label support, whereby each of said labels applied to said release layer is exposed outwardly relative to said arm and is readily appliable, removable and replaceable by another of said labels by merchandising personnel, wherein said release layer is a silicone material.

19. A method of maintaining current merchandising labels in association with merchandise being marketed from a merchandise hanger assembly that includes a merchandise display support having associated therewith an arm and a label support on the arm, which label support includes a merchandise label supporting surface, the method comprising the steps of:

applying over the merchandise label-supporting surface a release element which is securely affixed to the label support and has an exterior surface providing a label release surface, the label release surface having a characteristic release value for adhesive labels which is substantially less than the release value of said suporting surface for such labels and which causes adhesive labels to adhere thereto, when said labels are applied, but which allows such adhesive labels to be peeled cleanly from the label release surface without substantial tearing or delamination of the labels;

applying an adhesive label bearing current merchandising information to said label release surface for characterizing the merchandise carried on the merchandise display support;

when the merchandise or the merchandise characteristics change, peeling said adhesive label cleanly from said label release surface and applying a new adhesive label thereto bearing updated merchandising information; and repeating said last mentioned step each time the merchandising information changes using a plurality of successive updated adhesive labels which are similarly released, when needed, by said label release surface.

20. A method as in claim 19 including the step of mounting said merchandise display support in a generally horizontal position for holding products thereon and with said label supporting surface thereof disposed outwardly for viewing by passing customers for the merchandise thereon, and thereafter affixing said release element to said label supporting surface.

21. A method as in claim 19 wherein said release surface provides a bond strength to said adhesive labels which is less than the strength of attachment of said release surface to said label supporting surface and less than the tear strength of said labels.

22. A method as in claim 21 wherein each of said labels is a paper label with either a rubber-based or acrylic pressure sensitive attachment adhesive thereon.

23. A method as in claim 22 including providing a release value of less than about two pounds for peeling of said adhesive labels from said release surface.

24. A method as in claim 22 including providing a release value of between about 20 grams and about 160 grams for peeling of said adhesive labels from said release surface.

25. A method as in claim 22 providing a release value of less than about one pound for pressure sensitive adhesive labels adhered to said release surface.

26. A method as in claim 19 including providing a release value of between about 20 grams and about 160 grams for peeling of such adhesive labels adhered to said release surface.

27. A method as in claim 19 including providing a label release liner having an adhesive on one side thereof and a label release layer on an opposite side thereof which provides said release surface, and adhering said label release liner to said merchandise label supporting surface with said label release surface exposed outwardly for releasably retaining said labels thereon.

28. A method as in claim 27 wherein said label release layer is a coating of a silicone material.

29. A method as in claim 19 including applying a coating of a label release material to said label support surface to form said release element and provide said release surface.

30. A method as in claim 29 wherein said coating is a silicone material.

31. A method of maintaining current merchandising labels in association with merchandise being marketed from a merchandise hanger assembly that includes a merchandise display support having associated therewith an arm and a label support on the arm, which label support includes a merchandise label supporting surface, the method comprising the steps of:

applying over the merchandise label supporting surface a release element which is securely affixed to said label support and has an exterior surface providing a label release surface, the label release surface having a characteristic release value for adhesive labels which is substantially less than the release value of said supporting surface for such labels and which causes adhesive paper labels to adhere thereto, when said labels are applied, but which allows such adhesive paper labels to be peeled cleanly from the label release surface;

applying an adhesive paper label bearing current merchandising information to said label release surface for characterizing the merchandise carried on the merchandise display support;

when the merchandise or the merchandise characteristics change, peeling said paper label cleanly from said label release surface and applying a new adhesive paper label thereto bearing updated merchandising information; and repeating said last mentioned step each time the merchandising information changes using a plurality of successive updated paper adhesive labels which are similarly released, when needed, by said label release surface.

* * * * *